US005404913A

United States Patent [19]

Gilligan

[11] Patent Number: 5,404,913

[45] Date of Patent: Apr. 11, 1995

[54] FUEL REDUCTION DEVICE

[76] Inventor: Michael Gilligan, St Anthony's, Rousdon, Lyme Regis, Dorset DT7 3XP, United Kingdom

[21] Appl. No.: 126,390

[22] Filed: Sep. 27, 1993

[51] Int. Cl.[6] ..... F02M 33/00

[52] U.S. Cl. ..... 138/37; 138/44; 138/37; 123/538; 366/336

[58] Field of Search ..... 138/37, 39, 44; 366/336, 340, 331, 337; 123/536, 537, 538; 48/180.1, 182, 189.4

[56] References Cited

U.S. PATENT DOCUMENTS

| | | | |
|---|---|---|---|
| 1,688,613 | 10/1928 | Cogan | 138/37 |
| 1,885,559 | 11/1932 | Smith | 138/37 |
| 3,134,655 | 5/1964 | Boucher | 138/37 |
| 3,871,624 | 3/1975 | Huber et al. | 366/336 |
| 4,251,031 | 2/1981 | Martin et al. | 123/538 X |
| 4,590,915 | 5/1986 | Yamauchi et al. | 123/590 |
| 4,643,584 | 2/1987 | Allocca | 366/337 |
| 4,930,483 | 6/1990 | Jones | 123/538 |
| 5,069,191 | 12/1991 | Scouten | 123/538 |

*Primary Examiner*—David A. Scherbel
*Assistant Examiner*—Patrick F. Brinson
*Attorney, Agent, or Firm*—Ira S. Dorman

[57] ABSTRACT

A housing containing a fuel flow path contains an alloy core formed in two halves. Each half core includes rectangular support walls 1, 2 and 3 arranged in a T configuration. A pair of wedge-shaped elements 4 and 5 extend from each of the two co-planar walls 1 and 2 parallel to the intermediate wall 3 to cause turbulence in the fuel flow. The core is formed from an alloy which comprises tin, antimony and a greater percentage of mercury than lead. A trace amount of platinum may also be included.

5 Claims, 2 Drawing Sheets

FUEL REDUCTION DEVICE

TECHNICAL FIELD OF THE INVENTION

This invention relates to a device for reducing fuel consumption in an internal combustion engine, of the kind which includes a core comprised of various metals over which the fuel flows en route to the engine. Generally, the device further incorporates a magnetic core which subjects the fuel to a magnetic field. The device is applicable to petrol (leaded and unleaded) and diesel engines, and can also be used with two stroke engines.

BACKGROUND

Fuel reduction devices of the kind described in the preceding paragraph have been known since the 1930s. They were used with Rolls Royce Merlin engines in Spitfires and Hurricanes during the Second World War. Although the way in which such devices work is not fully understood, the advantageous results are well documented, and include the following:

Reduced fuel consumption (more kilometers per liter of fuel).

Increased engine power.

Reduced corrosion and engine wear.

Reduced emission of unburnt hydrocarbons, CO and NOx.

Without prejudice to the scope of the present invention, it is believed that the core adds trace amounts of certain metals to the fuel, which act as a lubricant. It is further believed that the magnetic field polarises the fuel hydrocarbons, enhancing oxidation of the fuel.

In a recent form of the device, the core is of uniform star-like section and is held within a cylindrical housing. Fuel enters the housing through one end, and after flowing axially between the arms of the star and passing a magnetic core, leaves via the opposite end of the housing. Analysis has shown that the composition of the alloy is 70% tin, 18% antimony, 8% lead and 4% mercury, by weight.

An aim of the present invention may be viewed as being to provide a form of the device which is more efficient in terms of further reducing fuel consumption.

SUMMARY OF THE INVENTION

According to a first aspect, the present invention proposes a fuel reduction device comprising a housing which defines a linear flow path for fuel, and an alloy core located in said flow path within said housing, in which the core includes an element which is disposed in said flow path and has a face which is inclined with respect to said flow path to cause turbulence in fuel flowing through said flow path.

The core preferably includes a plurality of elements disposed in the flow path of the fuel, each of the elements having a downstream end and an upstream end and having side faces which diverge in the direction of flow from the downstream end towards the upstream end.

The elements may be generally wedge-shaped.

Again without prejudice to the scope of the invention, the elements appear to increase the take-up of metals from the core into the fuel by dividing the fuel flow around the elements and creating turbulence at the downstream end of the elements.

In order to further increase the turbulence around the core with minimal restriction of fuel flow, the core preferably includes a plurality of sets of such elements, each set of elements comprising at least two elements which are aligned in the direction of flow of the fuel and being mutually spaced.

The core preferably comprises a number of support walls which extend parallel to the direction of fuel flow and from which the said elements project. The support walls may conveniently be arranged in a cruciform configuration. For ease of manufacture the core may be formed in two parts arranged back-to-back, each part comprising a pair of substantially co-planar rear support walls and an intermediate support wall projecting perpendicularly from the junction of the rear support walls, the said elements projecting from the rear support walls generally parallel to the intermediate wall.

According to a second aspect, the invention further proposes a fuel reduction device including an alloy core, in which the composition of the alloy includes tin and a greater percentage of mercury than lead, by weight.

The percentage of mercury in the alloy will normally lie in the range of 5% to 15% and is preferably within the range of 7% to 12%. Beyond the lower end of the range the advantageous effect of the mercury in reducing fuel consumption is greatly diminished. Above the higher end of the range no further significant reduction in fuel consumption is achieved and the emission of mercury is increased to an undesirable level.

The proportion of lead is preferably less than 7% and ideally less than 4%. Indeed, it is possible that lead might be omitted altogether, although it appears to be desirable to retain a small percentage.

The ratio of mercury to lead is preferably between 2:1 and 4:1 by weight, about 3:1 being optimum.

The combined weight of mercury and lead preferably makes up between 10 and 15% of the total weight of the alloy, ideally around 12%. The balance of the alloy will usually comprise tin as the major component and antimony as a minor component of the balance, by weight. Trace amounts of platinum may also be included to advantage.

BRIEF DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE DRAWINGS

Figure 1:
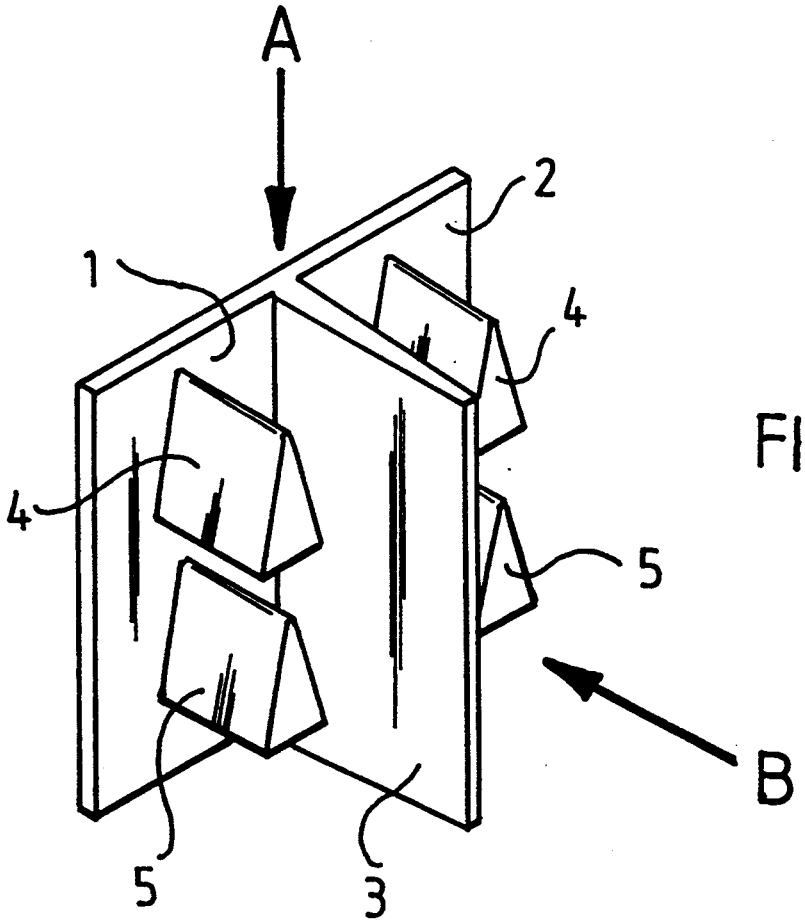
FIG. 1 is a general view of one half of an alloy core for use in a fuel reduction device of the invention.
Figure 2:
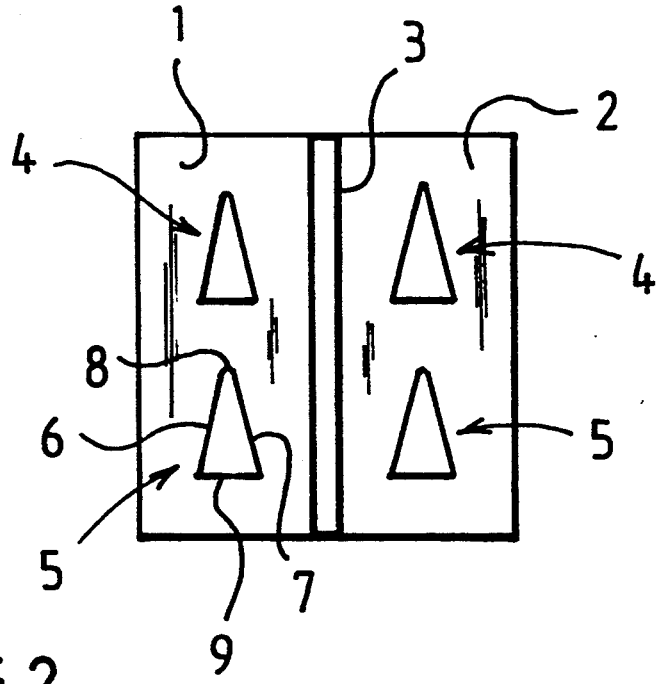
FIG. 2 is a side view of the core half, looking in direction B of FIG. 1.

Referring firstly to FIGS. 1 and 2, a core half 10 is cast from an alloy having the following composition, by weight:

| | |
|---|---|
| Tin | 70% |
| Antimony | 18% |
| Mercury | 9% |
| Lead | 3% |

-continued

| | |
|---|---|
| Platinum | 0.01% |

The half core includes three rectangular support walls 1, 2 and 3 of similar size and shape. The three walls are arranged in a T configuration parallel to a direction of flow A, with two of the walls 1 and 2 arranged co-planar to form a pair of rear walls, and the third wall 3 extending perpendicularly from the other two to form an intermediate support wall.

A pair of finger-like elements 4, 5 extend from each of the rear walls 1 and 2 substantially parallel to the intermediate wall 3. Each of these elements is generally wedge-shaped and includes a pair of substantially flat side walls 6 and 7 (FIG. 2) which diverge from a narrow upstream end face 8 to a flat downstream end face 9 arranged substantially perpendicular to the flow direction A. As can clearly be seen in FIG. 2, each pair of elements are mutually aligned in the flow direction A, with a small spacing between the two.

The core halves 10 are easy to cast in a simple mould using a centrifugal casting technique, from which the casting is removed in direction B.

Figure 3:
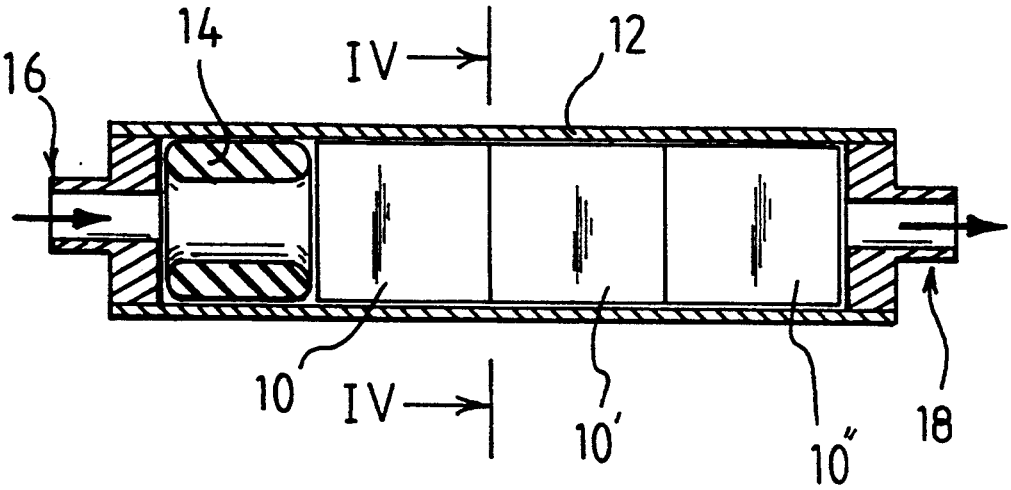
FIG. 3 is a longitudinal section through an assembled fuel reduction device incorporating the core halves of FIGS. 1 and 2.
Figure 4:
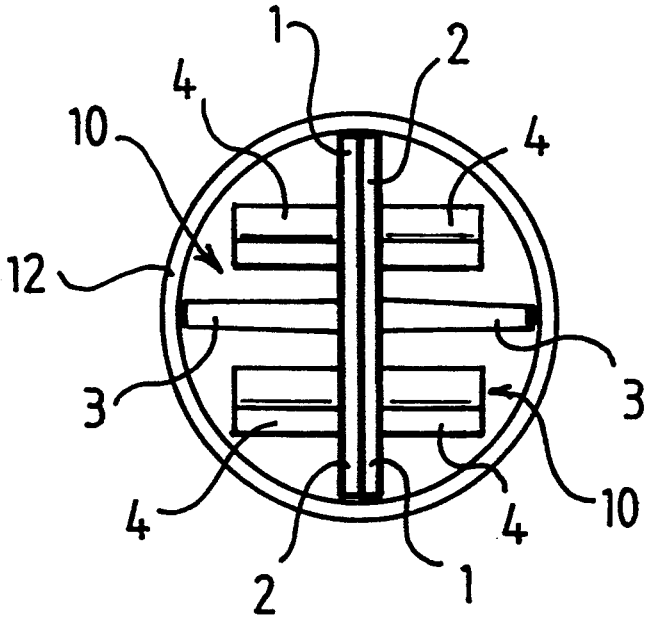
FIG. 4 is section IV—IV of FIG. 3, with the core halves viewed in direction A of FIG. 1.

The flow reduction device of FIGS. 3 and 4 is formed by placing a pair of such core halves 10 back-to-back with the rear faces 1 and 2 superimposed upon each other as shown in FIG. 4. The pair of core halves are then slid axially into a cylindrical housing 12, dimensioned such that the back-to-back core halves are a close fit therein. Further such pairs of core halves can be slid into the housing 12 to occupy an adjacent axial position, a total of three pairs being illustrated in FIG. 3 by way of example, designated 10, 10' and 10''. The number required depends upon the engine capacity, larger engines generally requiring greater core volume. A toroidal magnetic ferrite core 14 of known form is also included in the housing, upstream of the alloy core. A similar core could also be provided at the opposite, downstream end of the housing. The ends of the housing are provided with suitable connectors 16 and 18 so that the device can be coupled into the fuel line of an internal combustion engine as close as possible to the carburettor or injection pump.

When the fuel flows through the device the flow path is divided around the first element 4 as the fuel travels over the opposed divergent faces 6 and 7. Turbulence is created in the region of the downstream end face 9, before the flow path is again divided around the second element 5. In devices which include two or more sets of core halves, this process is repeated as the fuel flows past each element 4, 5. The surface contact between the fuel and the core is therefore greatly increased for a given core size with minimal restriction of flow. In addition, the higher proportion of mercury in the alloy further improves the efficiency of the device. As a result, the fuel consumption of the engine is significantly reduced compared with earlier devices of similar size.

The small quantity of platinum appears to assist in reducing fuel consumption, possibly be providing a catalytic effect. However, the platinum is not essential and could be omitted.

Any number of magnetic cores 14 could be included in the housing. The magnetic cores could alternatively be mounted externally of the housing.

I claim:

1. A fuel reduction device comprising a housing which defines a linear flow path for fuel, and an alloy core located in said flow path within said housing, in which the core includes a support wall extending substantially parallel to said flow path; and a set of at least two elements mutually spaced and aligned in a direction which is substantially parallel to said flow path and projecting from said support wall, each of said elements having a downstream end and an upstream end, and having a pair of faces thereon both inclined with respect to said flow path to diverge towards said downstream end and to cause turbulence in fuel flowing along said flow path.

2. A fuel reduction device in accordance with claim 1, wherein:

said elements are substantially wedge-shaped.

3. A fuel reduction device in accordance with claim 1, wherein:

said core includes a plurality of such sets of elements.

4. A fuel reduction device comprising a housing which defines a linear flow path for fuel, and an alloy core located in said flow path within said housing, in which the core includes a plurality of elements disposed in said flow path, each of said elements having a face which is inclined with respect to said flow path to cause turbulence in fuel flowing along said flow path, said core including two substantially coplanar support walls and an intermediate support wall projecting perpendicularly from the junction of said coplanar support walls, said support walls extending substantially parallel to said flow path, and said elements projecting from said coplanar support walls generally parallel to said intermediate support wall.

5. A fuel reduction device in accordance with claim 4, wherein:

said core is formed in two parts with the co-planar support walls arranged back-to-back.

* * * * *